US007631934B2

(12) United States Patent
Mac Isaac

(10) Patent No.: US 7,631,934 B2
(45) Date of Patent: Dec. 15, 2009

(54) FOLDABLE PORTABLE STADIUM CHAIR

(76) Inventor: Peter J. Mac Isaac, 71 Lake St., Cranston, RI (US) 02910

( * ) Notice: Subject to any disclaimer, the term of this patent is extended or adjusted under 35 U.S.C. 154(b) by 0 days.

(21) Appl. No.: 12/072,434

(22) Filed: Feb. 26, 2008

(65) Prior Publication Data

US 2009/0212614 A1 Aug. 27, 2009

(51) Int. Cl.
*A47C 1/08* (2006.01)

(52) U.S. Cl. ..... 297/252; 297/39; 297/352; 297/378.1; 297/217.7

(58) Field of Classification Search ..... 297/252, 297/352, 39, 17, 217.7, 378.1
See application file for complete search history.

(56) References Cited

U.S. PATENT DOCUMENTS 3,066,980 A * 12/1962 Clute ..... 297/252 X
3,994,529 A 11/1976 Lippert
5,042,875 A 8/1991 Biggs, Sr.
5,934,751 A * 8/1999 Johnson et al. ..... 297/252 X
6,116,676 A * 9/2000 Edwards ..... 297/352 X
D468,548 S 1/2003 Head, Jr.
6,502,902 B1 1/2003 Romero
6,592,187 B2 7/2003 Calvery

* cited by examiner

*Primary Examiner*—Anthony D Barfield
(74) *Attorney, Agent, or Firm*—James Ray & Assoc.

(57) ABSTRACT

A foldable portable stadium chair folds between a collapsed position for carrying and an open position for seating. Such chair includes an adjustable base member engageable with and securable to a bleacher bench, a chair frame coupled to the adjustable base member and having at least a portion thereof movable towards and away from the adjustable base member, a chair back coupled to a substantially vertical portion of the chair frame, and a chair seat coupled to a substantially horizontal portion of the chair frame.

4 Claims, 2 Drawing Sheets

FOLDABLE PORTABLE STADIUM CHAIR

FIELD OF THE INVENTION

The present invention relates, in general, to chairs and, more particularly, this invention relates to portable chairs and bleacher benches.

BACKGROUND OF THE INVENTION

Prior to the conception and development of the present invention, chairs, as are generally well known in the prior art, have been used as seating devices and portable chairs have been bring seating with a user when such user travels to various locations.

Specifically of interest to the present invention are the following: Calvery, U.S. Pat. No. 6,592,187, discloses a portable multipurpose chair providing hooks on a frame that can be hooked around a bleacher seat or alternatively be used as legs of the chair in outdoor environments.

Romero, U.S. Pat. No. 6,502,902, discloses a foldable, portable stadium seat using a forward, downward sloping cushioned seat formed in part by a stiff tubular frame.

Biggs, Sr., U.S. Pat. No. 5,042,875, discloses a portable seat assembly including a seat member, a back member, two spaced L-shaped arms connected by a cross-bar which functions as a carrying handle.

Lippert, U.S. Pat. No. 3,994,529, discloses a stadium chair assembly including pivotable legs and at least one pivotal holder located to swing downwardly to return the chair to a stadium bench with the legs folded up under the seat.

Head, Jr., U.S. Design Pat. No. D468,548 discloses an ornamental design for a portable stadium seat.

SUMMARY OF THE INVENTION

The present invention provides a foldable portable stadium chair that folds between a collapsed position for carrying and an open position for seating. Such foldable portable stadium chair includes an adjustable base member engageable with and securable to a bleacher bench, such adjustable base member being manufactured from a first predetermined material and having a first predetermined size and a first predetermined shape. A chair frame is coupled to such adjustable base member and has at least a portion thereof movable towards and away from such adjustable base member. A chair back is coupled to a substantially vertical portion of the chair frame, the chair back being manufactured from a second predetermined material and having a second predetermined size and a second predetermined shape. A chair seat is coupled to a substantially horizontal portion of the chair frame, the chair seat being manufactured from a third predetermined material and having a third predetermined size and a third predetermined shape.

OBJECTS OF THE INVENTION

It is, therefore, one of the primary objects of the present invention to provide a comfortable alternative to sitting on traditional bleachers.

Another object of the present invention is to provide a restback chair that will cradle the body of a user.

Another object of the present invention is to provide an easy to transport, stable, comfortable seat that can be placed on and removed from bleachers.

Still another object of the present invention is to provide a chair that will protect the body of a user against uncomfortable wooden and metal bleachers.

Yet another object of the present invention is to provide a chair that will alleviate aches and pains associated with sitting on bleachers for extended periods of time.

An additional object of the present invention is to provide a user with a comfortable seat for use at sporting events.

Still another object of the present invention is to provide a device that will permit a user to sit on a hammock style seat which secures to a bleacher bench.

In addition to the various objects and advantages of the present invention described with some degree of specificity above it should be obvious that additional objects and advantages of the present invention will become more readily apparent to those persons who are skilled in the relevant art from the following more detailed description of the invention, particularly, when such description is taken in conjunction with the attached drawing figures and with the appended claims.

Figure 1:
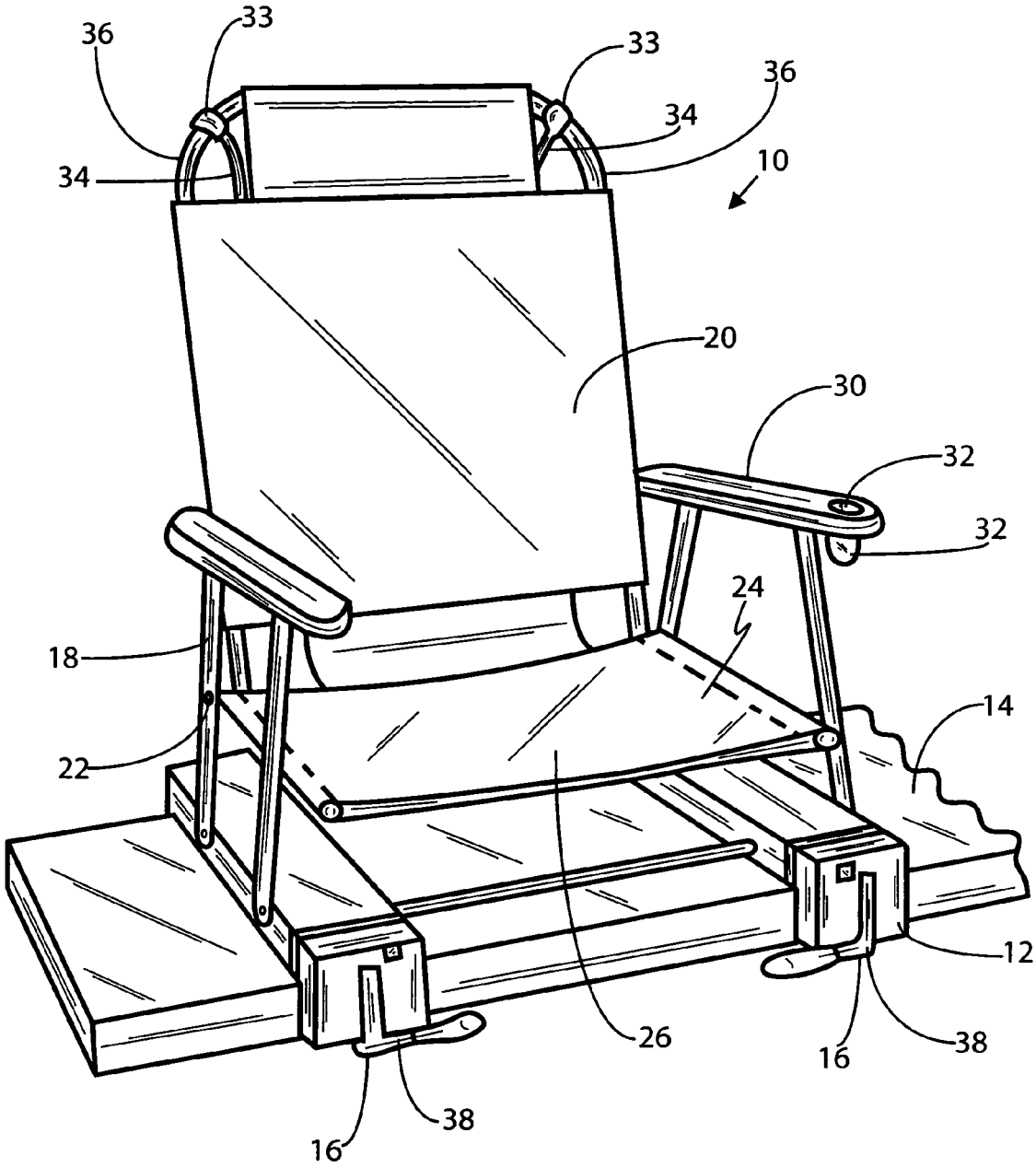
FIG. 1 is a partial perspective view of a foldable portable stadium chair according to one embodiment of the invention in which the foldable portable stadium chair is in an open position and is secured to a bleacher bench.

BRIEF DESCRIPTION OF A PRESENTLY PREFERRED AND VARIOUS ALTERNATIVE EMBODIMENTS OF THE INVENTION

Prior to proceeding to the more detailed description of the present invention it should be noted that, for the sake of clarity and understanding, identical components which have identical functions have been identified with identical reference numerals throughout the several views illustrated in the drawing figures.

Figure 2:
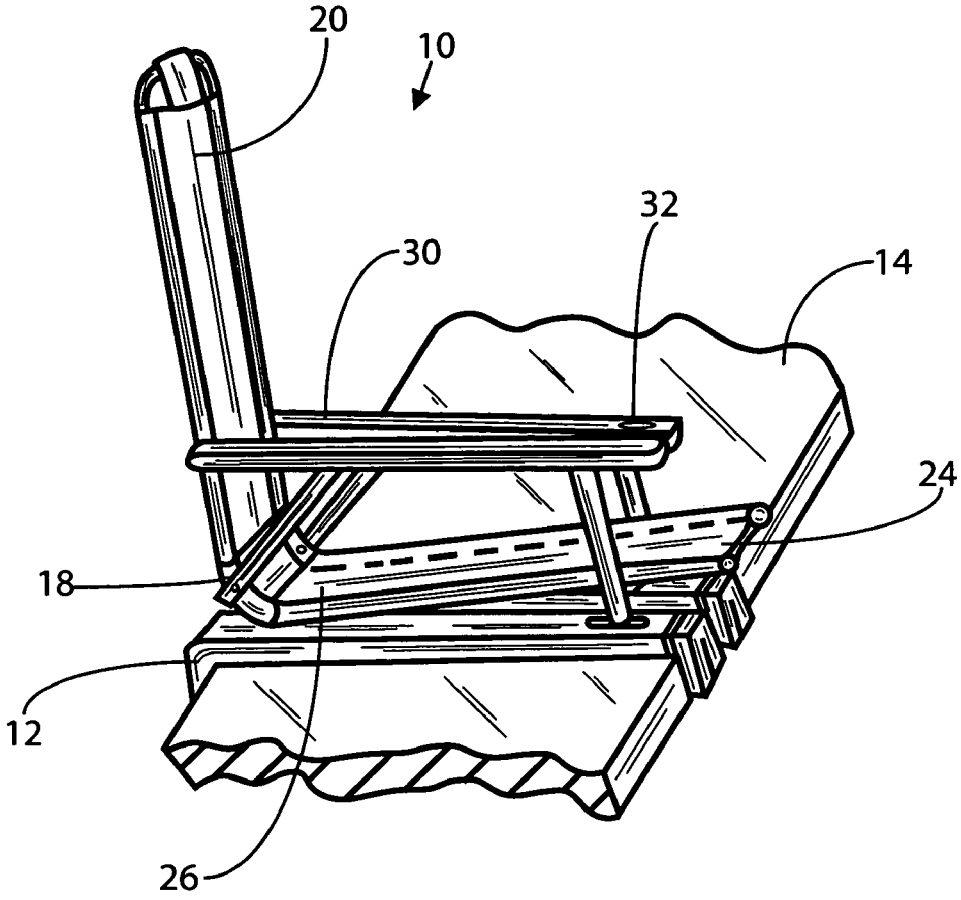
FIG. 2 is a partial perspective view of a foldable portable stadium chair according to one embodiment of the invention.
Figure 3:
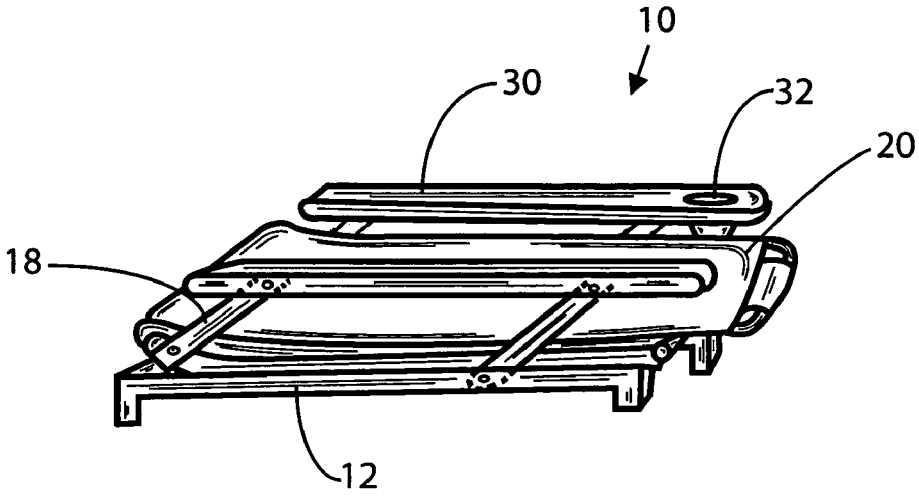
FIG. 3 is a partial perspective view of a foldable portable stadium chair according to one embodiment of the invention; in this illustration a side view of the chair in a closed position is shown.

Reference is now made, more particularly, to FIGS. 1-3.

A foldable portable stadium chair, generally designated 10, is provided. Such foldable portable stadium chair 10 folds between a collapsed position for carrying and an open position for seating. Such foldable portable stadium chair 10 includes an adjustable base member 12 engageable with and securable to a bleacher bench 14, such adjustable base member 12 being manufactured from a first predetermined material and having a first predetermined size and a first predetermined shape. It is presently preferred that such adjustable base member 12 is releasably securable to bleacher benches measuring between about 10" to 14" inches in width. It is further presently preferred that such adjustable base member 12 includes at least one first locking mechanism 16 for use in securing such adjustable base member 12 to a bleacher bench 14. It is also presently preferred that such adjustable base member is telescoping.

A chair frame 18 is coupled to such adjustable base member 12 and has at least a portion thereof movable towards and away from such adjustable base member 12.

A chair back 20 is coupled to a substantially vertical portion of such chair frame 18, the chair back 20 being manufactured from a second predetermined material and having a second predetermined size and a second predetermined shape.

It is presently preferred that at least one second locking mechanism 22 is coupled to the chair frame 18 for locking the chair back 20 into a generally upright position.

A chair seat 24 is coupled to a substantially horizontal portion of the chair frame 18, the chair seat 24 being manufactured from a third predetermined material and having a third predetermined size and a third predetermined shape. It is presently preferred that such chair seat 24 is a hammock style seat 26. It is further presently preferred that at least one cushion is attached to at least one of the chair back 20 and the chair seat 24.

In the presently preferred embodiment of the invention, at least one arm rest 30 is operably connected to the chair frame 18, the at least one arm rest 30 being manufactured from a fourth predetermined material and having a fourth predetermined size and a fourth predetermined shape. It is further presently preferred that such at least one arm rest 30 includes a cup holder 32. It is presently preferred that such at least one armrest 30 is padded.

It is presently preferred that at least one fastening means 33 is secured to and disposed on the chair frame 18 at a predetermined location thereon for securing such chair frame to such adjustable base member 12 when such foldable portable stadium chair 10 is in a closed position. It is further presently preferred that such at least one fastening means 33 is a hook and loop type fastening means 34.

It is presently preferred that a carrying means 36 is attached to the chair frame 18 at a predetermined location thereon.

In the presently preferred embodiment such foldable portable stadium chair 10 includes a means 38 for automatically opening such foldable portable stadium chair 10 such that when a user releases the at least one fastening means 33 the foldable portable stadium chair 10 will automatically open such that the chair back 20 is in a generally upright position. It is further presently preferred that when the chair back 20 reaches a generally upright position such first locking mechanism 16 will automatically secure such adjustable base member 12 to such bleacher bench 14.

It is presently preferred that such means 38 for automatically opening such foldable portable stadium chair 10 is at least one of a shock mechanism, a spring mechanism, and a combination shock and spring mechanism. It is presently most preferred that such automatic opening means 38 is a fluid pressure shock mechanism.

It is further presently preferred that such foldable portable stadium chair is water resistant.

While a presently preferred and various alternative embodiments of the present invention have been described in sufficient detail above to enable a person skilled in the relevant art to make and use the same it should be obvious that various other adaptations and modifications can be envisioned by those persons skilled in such art without departing from either the spirit of the invention or the scope of the appended claims.

I claim:

1. A foldable portable stadium chair that folds between a collapsed position for carrying and an open position for seating, said foldable portable stadium chair comprising:

a. an adjustable base member engageable with and securable to a bleacher bench, said adjustable base member being manufactured from a first predetermined material and having a first predetermined size and a first predetermined shape;

b. a chair frame coupled to said adjustable base member and having at least a portion thereof movable towards and away from said adjustable base member;

c. a chair back coupled to a substantially vertical portion of said chair frame, said chair back being manufactured from a second predetermined material and having a second predetermined size and a second predetermined shape;

d. a chair seat coupled to a substantially horizontal portion of said chair frame, said chair seat being manufactured from a third predetermined material and having a third predetermined size and a third predetermined shape; and e. a means operably connected to said chair frame for automatically opening said foldable portable stadium chair such that said foldable portable stadium chair will automatically open from a closed position wherein said chair back is in a substantially parallel position to said chair seat to an open position wherein said chair back is in a generally upright position substantially perpendicular to said chair seat.

2. A foldable portable stadium chair, according to claim 1 wherein upon said chair back reaching said generally upright position said first locking mechanism automatically secures said adjustable base to such bleacher bench.

3. A foldable portable stadium chair, according to claim 1 wherein said means for automatically opening said foldable portable stadium chair is at least one of a shock mechanism, a spring mechanism, and a combination shock and spring mechanism.

4. A foldable portable stadium chair, according to claim 1 wherein said means for automatically opening said foldable portable stadium chair is a fluid pressure shock mechanism.

* * * * *